US010736378B2

(12) United States Patent
Poloni et al.

(10) Patent No.: US 10,736,378 B2
(45) Date of Patent: Aug. 11, 2020

(54) WATERPROOF AND VAPOR-PERMEABLE SOLE FOR SHOES

(71) Applicant: GEOX S.p.A., Montebelluna, Frazione Biadene (IT)

(72) Inventors: Livio Poloni, Caerano di San Marco (IT); Mario Polegato Moretti, Crocetta del Montello (IT)

(73) Assignee: GEOX S.p.A., Montebelluna, Frazione Biadene (IT)

( * ) Notice: Subject to any disclaimer, the term of this patent is extended or adjusted under 35 U.S.C. 154(b) by 174 days.

(21) Appl. No.: 15/736,839

(22) PCT Filed: Jun. 8, 2016

(86) PCT No.: PCT/EP2016/062984
§ 371 (c)(1),
(2) Date: Dec. 15, 2017

(87) PCT Pub. No.: WO2016/202658
PCT Pub. Date: Dec. 22, 2016

(65) Prior Publication Data

US 2018/0160765 A1 Jun. 14, 2018

(30) Foreign Application Priority Data

Jun. 15, 2015 (IT) ..... 102015000023585

(51) Int. Cl.
*A43B 7/08* (2006.01)
*A43B 7/12* (2006.01)
*A43B 13/14* (2006.01)

(52) U.S. Cl.
CPC ..... *A43B 7/087* (2013.01); *A43B 7/088* (2013.01); *A43B 7/125* (2013.01); *A43B 13/14* (2013.01)

(58) Field of Classification Search
CPC ..... A43B 7/08; A43B 7/082; A43B 7/088; A43B 7/125; A43B 13/122; A43B 7/087
(Continued)

(56) References Cited

U.S. PATENT DOCUMENTS 4,912,858 A * 4/1990 Mochizuki ..... A43B 7/06 36/3 B
7,918,041 B2 * 4/2011 Cho ..... A43B 7/081 36/28

(Continued)

FOREIGN PATENT DOCUMENTS

CN 102573550 A 7/2012
EP 1 245 166 A1 10/2002

(Continued)

OTHER PUBLICATIONS

International Search Report dated Sep. 13, 2016 in PCT/EP2016/062984 filed Jun. 8, 2016.

(Continued)

*Primary Examiner* — Sharon M Prange
(74) *Attorney, Agent, or Firm* — Oblon, McClelland, Maier & Neustadt, L.L.P.

(57) ABSTRACT

A waterproof and vapor-permeable sole for shoes, including: a first contoured element including at least one hollow lower portion in the plantar region, delimited by a border and including at least one through opening, at least one second contoured and flat element, which is joined in a lower region with respect to the first element; at least one functional element substantially in sheet form, which is waterproof and vapor-permeable and is joined in an upper region to provide a seal to the first element. The second element has a shorter extension than the respective hollow lower portion to define with the border a surrounding slot.

10 Claims, 4 Drawing Sheets

(58) Field of Classification Search
USPC ..... 36/3 B
See application file for complete search history.

(56) References Cited

U.S. PATENT DOCUMENTS

| | | | | |
|---|---|---|---|---|
| 2005/0138838 | A1* | 6/2005 | Lin | A43B 7/081 36/3 B |
| 2005/0229431 | A1* | 10/2005 | Gerlin | A43B 7/125 36/25 R |
| 2007/0028483 | A1* | 2/2007 | Miyata | A43B 1/0045 36/3 B |
| 2009/0056172 | A1 | 3/2009 | Cho | |
| 2012/0151805 | A1* | 6/2012 | Polegato Moretti | A43B 7/06 36/25 R |
| 2013/0047472 | A1* | 2/2013 | Shih | A43B 3/0042 36/25 R |
| 2013/0232824 | A1 | 9/2013 | Bier et al. | |

FOREIGN PATENT DOCUMENTS

| | | | |
|---|---|---|---|
| WO | WO 2011/023509 | A1 | 3/2011 |
| WO | 2014/157773 | A1 | 10/2014 |

OTHER PUBLICATIONS

Italian Search Report and Written Opinion dated Apr. 22, 2016 in Italian Application IT UB20151402.
Combined Chinese Office Action and Search Report dated Jan. 20, 2020, in Patent Application No. 201680034643.5 (with English translation), 12 pages.

* cited by examiner

WATERPROOF AND VAPOR-PERMEABLE SOLE FOR SHOES

The present invention relates to a waterproof and vapor-permeable sole for shoes.

It is known by now that a shoe is comfortable if, in addition to the anatomically fitting properties and waterproofing, it is capable of ensuring a correct exchange of heat and water vapor between the microclimate inside the shoe and the external microclimate, which coincides with the ability to dissipate outward the water vapor that forms due to the perspiration of the foot.

The part of the foot that is usually most subject to sweating is the sole. The sweat saturates the internal environment of the shoe and mostly condenses, stagnating on the insock.

Italian patent 1232798 discloses shoes that solve the problem of vapor permeation by being provided with a rubber sole through which correct vapor permeation is ensured by way of an effective exchange of heat and water vapor between the environment inside the shoe and the external environment.

Such rubber sole ensures at the same time the necessary waterproofing with respect to external humidity and water.

Such sole is in fact constituted by a tread made of perforated elastomer, with which a vapor-permeable and waterproof membrane is associated in an upward region so as to cover its through openings.

However, the limited mechanical strength that usually characterizes these membranes leads to the penetration of foreign objects, which enter through the holes of the sole, which the membrane faces.

This problem is often solved by coupling below the membrane protective layers, such as for example a support made of felt or of other diffusely perforated material.

However, these protective layers decrease the vapor permeation of the membrane and stiffen the structure, in addition to increasing its weight, reducing its level of comfort.

Moreover, other drawbacks suffered by shoes with a sole made of perforated elastomer and a membrane reside in that they are unable to ensure the correct level of thermal insulation in countries characterized by cold climates and also in that the surface occupied by the holes is much smaller than the total area of the sole, limiting air circulation. On the other hand, the number of holes and their diameter necessarily must be modest in order to prevent pointed foreign objects from entering through said holes.

This circulation is not optimum, also due to the substantially total contact of the membrane with the rubber of the tread.

Reduced air circulation makes it difficult to exchange humidity from the inside to the outside of the shoe, consequently reducing vapor permeation through the membrane.

Moreover, the amount of water vapor extracted from the shoe increases as the rate at which the filler layer that lies above the membrane dries, since it is this layer that collects the perspiration generated by the foot.

In order to increase air circulation, it would be necessary to increase the dimensions of the perforated surface of the tread, with a consequent increase in the vulnerability of the membrane.

A solution might be to provide vapor-permeable rubber soles with ventilation holes in the tread that have an inclined extension with respect to the ground resting arrangement.

In this manner, the membrane would be more protected against pointed objects that might enter through the holes; however, in the practical embodiment of such treads, which usually must be obtained by injecting plastic material in a mold, it would be necessary to provide appropriate undercuts on the mold, with consequent considerable structural complexities and technical difficulties.

Another drawback is mud, which easily enters the holes until it accumulates on the surface of the membrane, reducing its vapor permeation ability.

Moreover, a significant problem is the fact that the through holes reduce the insulation that the tread offers with respect to the ground and, in the presence of frozen ground, this causes a significant reduction of the insulation capacity of the entire shoe.

EP1089642, by the same inventor, discloses a sole for a shoe that comprises a lower element and an upper element, in which the former has a hollow upper region that is delimited by an edge with lateral openings for air passage and the latter is vapor-permeable or perforated at right angles to the ground resting arrangement. A waterproof and vapor-permeable membrane is interposed between the two, and the two elements and the membrane are joined hermetically in the perimetric regions of mutual contact.

This solution has been found to be able to solve some of the mentioned drawbacks, since it ensures a good exchange of heat and water vapor between the inside of the shoe and the outside, at the same time safeguarding the total waterproofness and the integrity of the membrane.

However, the structure of the sole has not been found to be able to prevent the accumulation of dirty material on the vapor-permeable membrane. The lateral openings expose the membrane to the action of dirt, water and foreign objects, which can occlude said openings partially or fully, compromising even only partly their functionality, in addition to spoiling the aesthetic impact of the entire shoe.

Furthermore, the fact that the openings thus exposed outward expose the shoe directly to the air, even the freezing air of the coldest periods of the year or of Nordic countries, is not negligible.

Another solution is the one disclosed in WO2004037031, which provides for horizontal tubular pumping elements that run transversely to the shoe in order to force the passage of air and have open ends provided with a barrier that is permeable to air but waterproof.

In a similar manner, WO2007054983 discloses the teachings to provide a sole that comprises a recess or hollow area, at the level of which a plurality of through holes is provided, and which is adapted to accommodate a substantially flat insert that has channels or grooves at the holes, with inlets at the outer lateral surface of said insert. The channels or grooves can also be contained within the recess or the hollow area, at the same level as those present in the insert. Valves that allow the expulsion of the vapor are arranged at the inlets and are closed by a waterproof and vapor-permeable material or by a micromesh, which prevent the inflow of water, dirt or foreign objects.

The solutions proposed in these last two documents entail the use of components, such as for example the valves, that affect significantly the times of the process for the assembly of the elements that compose the shoe and therefore also affect the end cost.

Furthermore, the effectiveness and durability of the waterproof and vapor-permeable barriers that close the inlets of the valves are not predictable and reliable due to the fact that their direct exposure to interaction with external objects can cause their deterioration or separation.

The aim of the present invention is to provide a waterproof and vapor-permeable sole for shoes that allows the exchange of heat and water vapor so as to ensure an optimum internal microclimate as a function of the external climate, obviating the drawbacks of the solutions known so far.

Within this aim, an object of the invention is to provide a sole that is suitable for shoes for the coldest climates, ensuring an adequate level of insulation.

Another object of the invention is to provide a sole that protects effectively the integrity of the vapor-permeable membrane while allowing an adequate circulation of air.

A further object of the invention is to provide a sole that is not subject to the deposition of dirt on the vapor-permeable membrane.

Another object is to provide a vapor-permeable and waterproof sole the structure of which can be adapted easily to the most disparate shoes, both for everyday use and for sports use.

Another object of the invention is to provide a sole whose cost is comparable to the costs of currently known soles.

Another object of the present invention is to provide a vapor-permeable and waterproof sole that is structurally simple and can be manufactured with technologies and equipment that are conventional in the field.

Another object of the invention is to provide a waterproof and vapor-permeable sole that can be used to ensure an adequate circulation of air also in special shoes such as safety shoes.

This aim, as well as these and other objects that will become better apparent hereinafter, are achieved by a waterproof and vapor-permeable sole for shoes which comprises:

a first contoured element that has at least one hollow lower portion in the plantar region, delimited by a border and provided with at least one through opening at right angles to the ground resting arrangement, which in turn is delimited by a margin that is internal to said border, at least one second contoured and flat element, which is joined in a lower region with respect to said first element with a perimetric margin thereof to said margin in the points of mutual contact and the upper surface of which is provided with recesses and protrusions that define passages for air, vapor and liquids, at least one functional element substantially in sheet form, which is waterproof and vapor-permeable and is joined in an upper region so as to provide a seal to said first element along said margin, said second element having a shorter extension than the respective said hollow lower portion and defining with said border a slot that surrounds it and defining with said margin, in the regions of no contact, extensions for said passages toward the outside, connecting them to said slot.

Further characteristics and advantages of the invention will become better apparent from the description of a preferred but not exclusive embodiment of the sole according to the invention, illustrated by way of nonlimiting example in the accompanying drawings, wherein.

Figure 1:
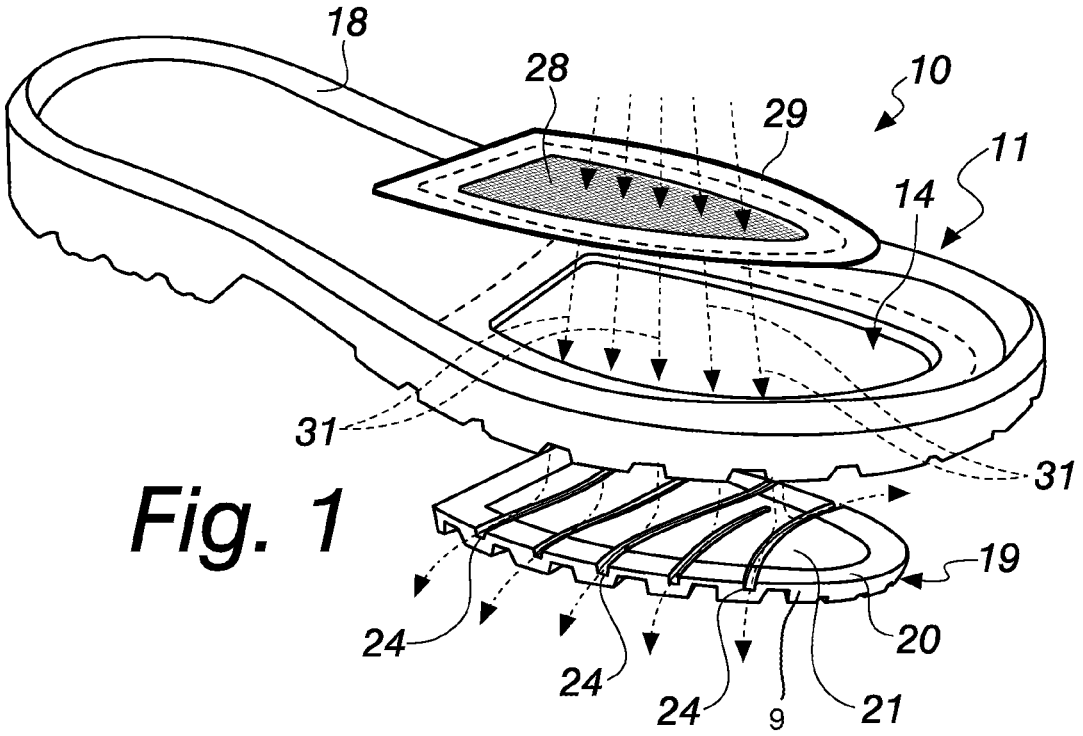
FIG. 1 is an exploded perspective view of a sole according to the invention.

With reference to the figures, the sole according to the invention is designated generally by the reference numeral 10.

Figure 2:
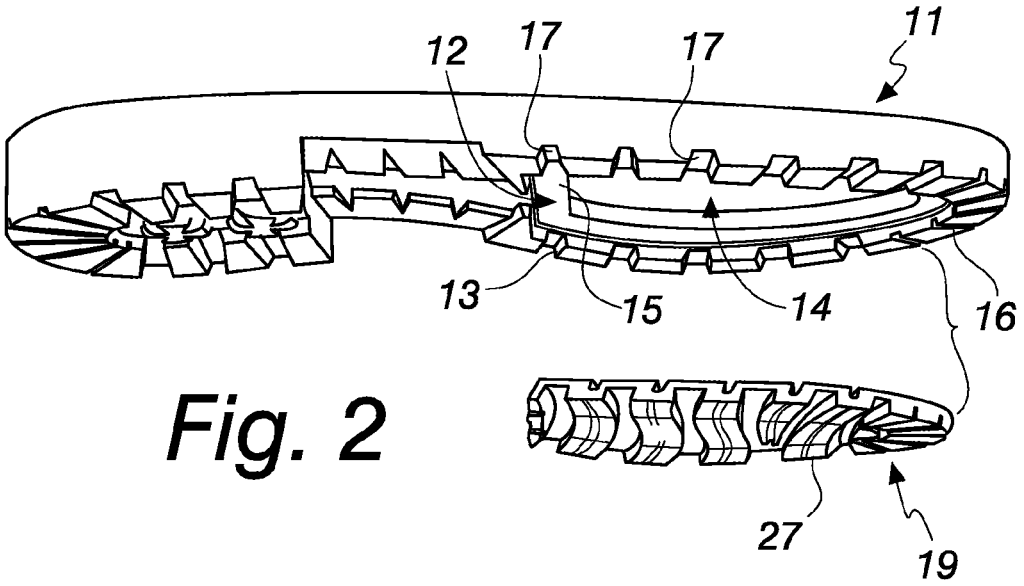
FIG. 2 is a view of the first element and of the second element separated.

The sole comprises a first contoured element 11, made of polymeric material, which has a hollow lower portion 12 (shown in FIG. 2) in the plantar region, which is delimited by a border 13 and is provided with a through opening 14 at right angles to the ground resting arrangement. The latter in turn is delimited by a margin 15 that is internal to the border 13.

In particular, the hollow lower portion 12 is at the forefoot of the sole 10, while in the part of the waist and of the heel the first element 11 is contoured in a known manner and, in this example, has no other openings.

A first tread 16 for resting on the ground is integrated with the first element 11 in the lower part.

The surface of the first tread 16 can be continuous or can be alternatively interrupted in some of its portions, depending on the aesthetic or functional design that one wishes to provide. In the illustrated example, the border 13 is provided with channels 17 which outline the tread 16 and are extended in a direction that is parallel to the ground resting arrangement toward the outer lateral edge, connecting the hollow lower portion 12 to the outside.

In the upper part, the first element 11 is substantially flat, except for appropriate contouring of the sole of the foot, and a ridge 18, shown in FIG. 1, is extended along all of its perimeter.

The sole 10 also comprises a second contoured and flat element 19, which is joined in a downward region with respect to the first element 11 with a perimetric margin 20 thereof to the margin 15 in the points of mutual contact and the upper surface of which is provided with recesses and protrusions 21 that define passages for air, water vapor and liquids.

Figure 3:
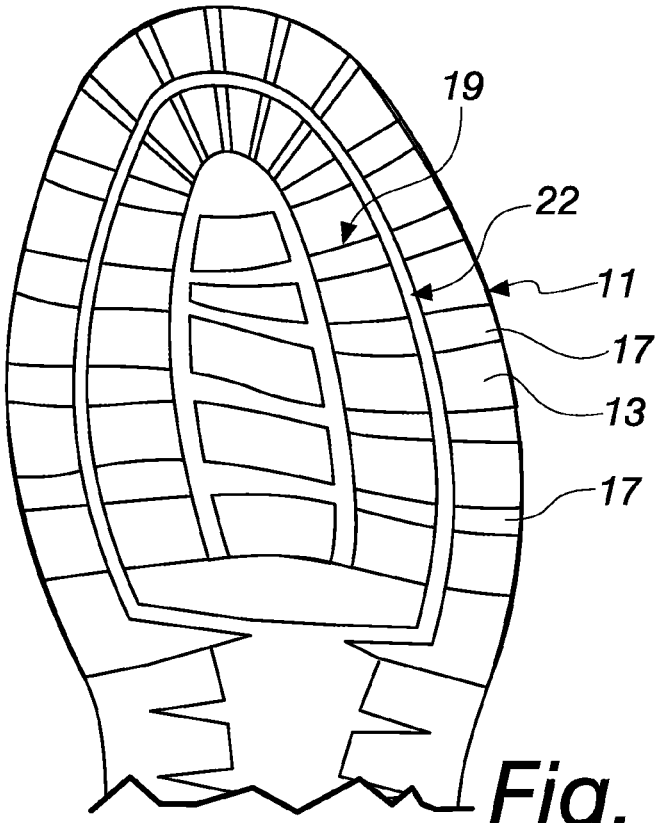
FIG. 3 is a bottom view of a portion of the sole according to the invention.

The second element 19 has a shorter extension than the respective hollow lower portion 12 and a greater one than the respective through opening 14. A side surface 9 of the second element 19 defines, with the border 13, a slot or gap 22 that is open downward and surrounds it, as shown in the plan view of FIG. 3.

The border 13 of the first element 11 is provided at a distance from the edge of the through opening 14 that is comprised preferably between 5 and 8 mm and the dimensions of the second element 19 are such that it, also, is spaced from the edge of the latter preferably by 1 mm and at the most by 3 mm, thus defining the slot 22.

Figure 4:
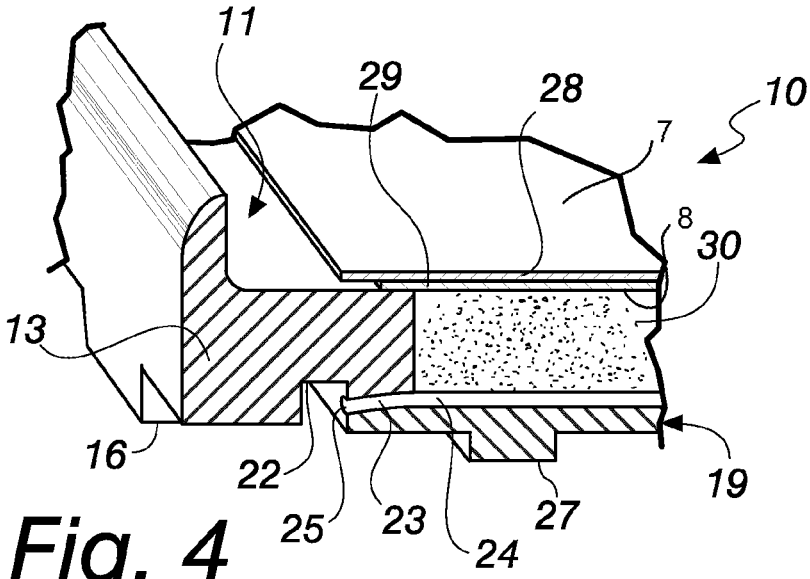
FIG. 4 is a sectional view of a portion of the sole according to the invention.
Figure 5:
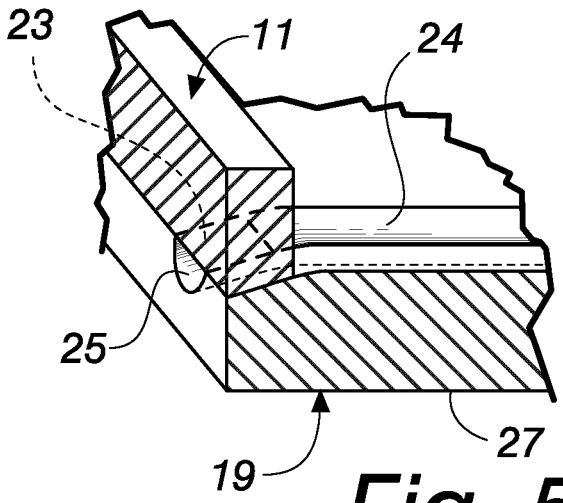
FIG. 5 is an enlarged-scale sectional view of a detail of a portion of the sole according to the invention.

The second element 19 defines with the margin 15, in the regions of no contact, extensions 23 for the outward passages, connecting them to the slot 22, as can be seen in the sectional views of FIG. 4 and FIG. 5.

The passages on the second element 19 are in fact defined by grooves that are substantially transverse to the direction of extension of the sole 10. They are designated by the reference numeral 24 in the view of FIG. 1 and in the sectional views of FIG. 4 and FIG. 5.

In particular, with reference to FIGS. 4 and 5, it can be noted that the first element 11 and the second element 19, when coupled, generate the extensions 23, which end with outward lateral openings 25, from which the passages of the second element 19 are connected to the slot 22.

The grooves 24, which define the passages on the second element 19, are extended outward and are conveniently inclined downward, thus facilitating by gravity the exit of any liquids that might penetrate through the lateral openings 25.

The two elements, the first one 11 and the second one 19, may be both shaped or only one of the two may be shaped with recesses and protrusions so as to define the extensions 23 in the sealing region of the two.

Therefore, the lateral openings 25 can be obtained by shaping only the upper surface of the second element 19, as shown in the sectional views of FIG. 4 and FIG. 5. In this case they are due to the grooves 24, which are extended to the external perimeter and face, along the perimetric margin 20, the lower surface of the first element 11.

In an alternative version, which is not shown, the extensions, and therefore the lateral openings, may be due to recesses on the lower surface of the first element, again in the region for sealing with the second element, while the latter can have a smooth perimetric margin.

According to another possibility, the extensions and the lateral openings may be due to the combination of the extensions of the grooves to the outer edge of the second element with recesses or grooves on the lower surface of the first element.

Figure 6:
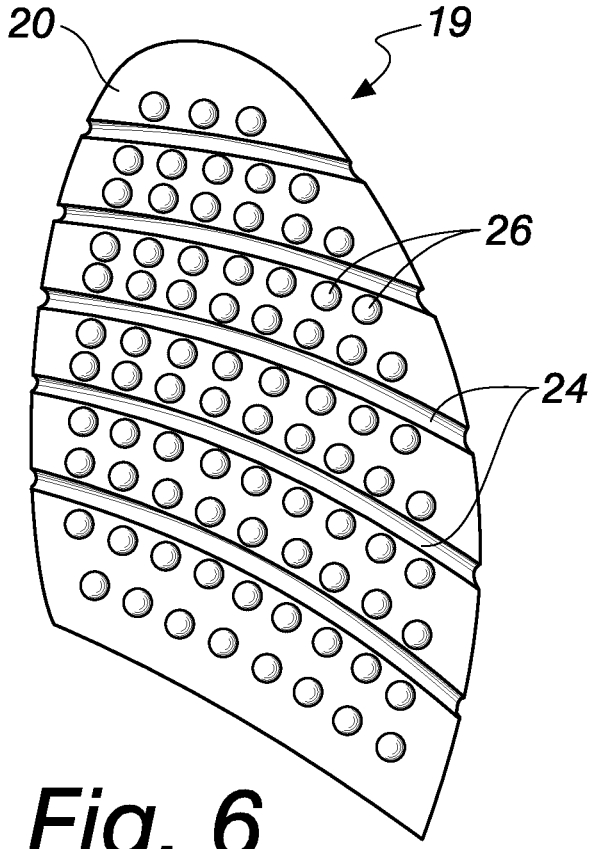
FIG. 6 is a view of an alternative version of a second element.

In an alternative version of the second element 19, shown in FIG. 6, such element is provided with raised portions 26 within the perimetric margin 20 which are dome-shaped, in addition to the channels 24.

The association of the first element 11 and of the second element 19 occurs preferably by adhesive bonding in the points of mutual contact. Coupling means may also be provided for the two elements which are complementary with respect to adhesive bonding and can comprise for example protrusions or tabs which, by extending from the upper surface of the second element, are adapted to enter adapted holes of the first element 11 or vice versa. Such means maintain the position between the two elements and can be conveniently made of the same polymeric material of which the elements are constituted and by means of the same production process (preferably molding, pouring or vulcanization). In some cases they can be made of different material and/or co-molded.

In addition to what has been described, the sole 10 can have more than one second element and accordingly the first element can have more than one corresponding through opening and more than one hollow region, for example, not only at the forefoot but also at the plantar arch and/or at the heel.

A tread, referenced as second tread 27, is integrated in the lower part also with the second element 19, like the first one 11.

In addition to the two elements described, the sole 10 comprises a functional element 28 substantially in sheet form having an upper surface 7 and a lower surface 8, which is waterproof and vapor-permeable and is joined in an upper region hermetically to the first element 11 substantially along the margin 15 in order to avoid the infiltration of humidity.

The functional element 28 comprises a membrane made of expanded polytetrafluoroethylene (e-PTFE), which is microporous or the like, is waterproof and is permeable to water vapor and air. Preferably, the membrane can be laminated with at least one supporting mesh made of plastic material.

As an alternative to the membrane, the functional element 28 can comprise an insert with a monolithic, stratified and cohesive sheet-like structure, which comprises a plurality of waterproof and vapor-permeable functional layers made of polymeric material that is waterproof and permeable to water vapor, such as the one disclosed in EP2298099 by the same Applicant, or an insert having a monolithic structure, made of polymeric material that is waterproof and permeable to water vapor, such as the one disclosed in EP2298101 again by the same Applicant.

The functional element 28 further can comprise a protective layer (not shown) of the membrane, which lies below it so to not compromise its vapor permeability, for example by spot gluing with an adhesive that is resistant to hydrolysis. It is possible to use an adhesive that is easily commercially available and is known commonly as "hot melt" or, as an alternative, with a system using calendered powders.

The protective layer is usually made of vapor-permeable material capable of drying in a short time, such as for example a layer of felt made of non-woven fabric, which is conveniently treated to make it water-repellent. In this case the protective layer is arranged conveniently between the membrane and the second element 19 in order to protect the membrane against stresses or dirt that might enter through the lateral openings 25.

The margin 15, for a width comprised between 5 mm and 8 mm, defines on the upper part a sealing surface for joining the functional element 28 to the first element 11.

The functional element 28 conveniently has a greater extension than the through opening 14, covering the margin 15 and therefore the sealing surface. The functional element 28 is glued and sealed in a waterproof manner on the sealing surface by using an adhesive for example of the polyurethane-based type.

Advantageously, a ring 29 made of waterproof material, for example PVC, is superimposed and sealed, on the upper side of the first element 11, in a waterproof manner so as to straddle the functional element 28 and the margin 15. The ring 29 is visible in the perspective view of FIG. 1 and in the sectional view of FIG. 4.

The coupling between the second element 19 and the first element 11, on which the functional element 28 is sealed, causes between the upper surface of the second element 19 and the functional element 28 a region that is delimited parametrically by the edge of the margin 15. This region can be left free, constituting substantially an air chamber, or can be occupied by a filler element 30 which is vapor-permeable or perforated and occupies the through opening 14 between the second element 19 and the functional element 28.

In the first case it is more convenient to structure the sole 10 with a second element 19 in the version shown in FIG. 6. In this manner, the functional element 28 can rest on the raised portions 26, preventing it from collapsing against the upper surface of the second element 19 as a consequence of the pressure applied by the foot, thus maintaining the air chamber.

This situation is suitable for example in the case of particularly thin soles, in which there is the need to contain the total volume of the sole.

In the second case a filler element 30 is used which is preferably water-repellent and permeable to water vapor.

The filler element 30 can be constituted, as in the case shown in the sectional view of FIG. 4, by a three-dimensional fabric.

The expression "three-dimensional fabric" is commonly understood to reference a single fabric the component fibers of which are arranged in a mutually perpendicular planar relationship. From the point of view of the production process, in a weave of the 3-D type the sets of fibers X and Y are woven with the rows and columns of the axial fibers Z. The expression "sets of fibers X and Y" is understood to reference respectively the horizontal and vertical weft sets. The expression "fibers Z" is understood to reference the multilayer warp set. It is possible to obtain three-dimensional fabrics also with weaving processes of the 2-D type.

Three-dimensional fabrics are usually formed by multiple layers, with a variable distance between the fibers, and have excellent properties of kinetic energy absorption, resiliency and shape recovery. Moreover, they allow an excellent transverse and longitudinal stream of air within their structure.

Such element is therefore capable of absorbing the stresses.

Figure 8:
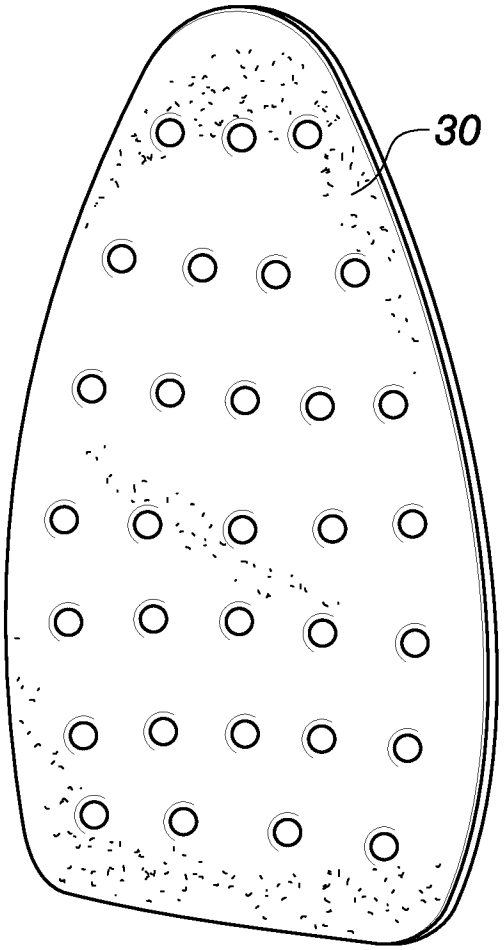
FIG. 8 is a view of another example of a filler layer.
Figure 7:
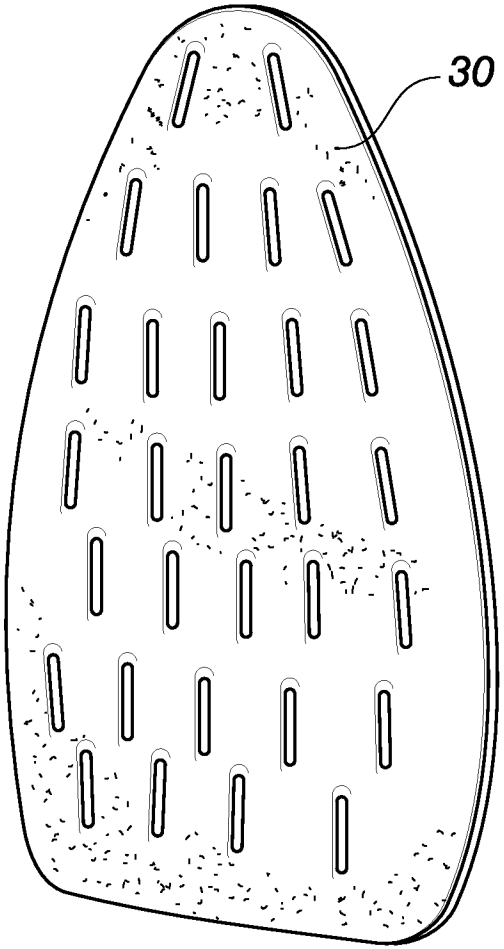
FIG. 7 is a view of an example of a filler layer of the sole according to the invention.

As an alternative, the filler element 30 is constituted by a layer of perforated waterproof material, as in the two versions shown in FIG. 7 and in FIG. 8. In this case, the material of which the filler element 30 is constituted is preferably ethylene vinyl acetate (EVA), and is provided with elongated holes, as in the example of FIG. 7, or circular holes, as in the example of FIG. 8.

The air chamber is connected directly to the lateral openings 25 and is therefore constantly connected to the outside, ensuring perfect ventilation also due to the pumping of the foot that compresses the air chamber when present or when occupied by the filler element 30 made of three-dimensional fabric.

When the filler element 30 is instead constituted by a layer made of EVA or the like, it allows itself to be crossed by the water vapor and by the air at the adapted holes, without absorbing the perspiration.

The slope of the grooves 24, further, facilitates the outflow of the liquids that are able to penetrate the sole 10 through the lateral openings 25, so that they do not stagnate inside it.

The ventilation that is ensured to the air chamber by the passages on the surface of the second element 19 and by the lateral openings 25 allows quick disposal of the perspiration from the upper part of the sole 10, through the functional element 28, to the outside.

The path of the vapor and of the perspiration moving away from the sole of the foot is shown in broken lines in FIG. 1 and is designated by the reference numeral 31.

The sole 10 is therefore capable of allowing the exchange of heat and water vapor so as to ensure, for the shoe to which it belongs, always an optimum internal microclimate as a function of the external climate. The lateral openings 25 that connects the inside of the sole 10 to the outside environment are in fact not directly exposed to the environment since they face the slot 22 and are therefore protected by the border 13, ensuring a better level of insulation with respect to some breathable soles of the known type.

In practice it has been found that the invention achieves the intended aim and objects, by providing a waterproof and vapor-permeable sole for shoes that is capable of ensuring a good exchange of heat and water vapor between the inside and the outside of the shoe, at the same time safeguarding waterproofness, ensuring an optimum internal microclimate as a function of the external climate and an adequate level of insulation and thus being suitable also for shoes for colder climates.

Despite allowing an adequate circulation of air, the sole 10 according to the invention is capable of protecting the integrity of the vapor-permeable membrane, or in general of the functional element, preventing it from being reached by foreign objects, and also prevents dirty material from reaching it, by way of the particular structural configuration.

The present invention, moreover, provides a waterproof and vapor-permeable sole that can be adapted easily to shoes of different types, both for everyday use and for sports use.

Furthermore, the described sole can be obtained with technologies and equipment that are conventional in the field and with a cost that can be compared to the costs of traditional soles.

Another advantage of the sole according to the invention resides in that its described structure is such that it can be used to ensure an adequate circulation of air even in special shoes such as safety shoes.

Such shoes in fact must be provided with soles that cannot be pierced and in which in many cases metallic protective laminas are inserted conveniently.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. 102015000023585 (UB2015A001402) from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A waterproof and vapor-permeable sole for shoes, comprising:

a first contoured element including at least one hollow lower portion in a plantar region, delimited by a border and including at least one through opening at right angles to a ground resting arrangement, which in turn is delimited by a margin that is internal to the border;

at least one second contoured and flat element, which is joined in a lower region with respect to the first element with a perimetric margin thereof to the margin in points of mutual contact and an upper surface of which includes recesses and protrusions that define passages for air, vapor, and liquids; and at least one functional element in sheet form, which is waterproof and vapor-permeable and is joined in an upper region to provide a seal to the first element along the margin to thereby delimit an air chamber between an upper surface of the second element and a lower surface of the functional element, wherein the air chamber is delimited perimetrically by an edge of the margin, wherein the second element has a shorter extension than the respective hollow lower portion, wherein the second element includes a side surface that defines with the border a gap, the gap being formed between the side surface and the border and surrounding the second element, and wherein the second element defines with the margin, in regions of no contact, extensions for the passages to thereby connect the passages to the gap.

2. The sole according to claim 1, wherein the border includes channels that are extended parallel to the ground resting arrangement toward the outer lateral edge.

3. The sole according to claim 1, wherein the passages of the second element are defined by grooves that are transverse to the direction of extension of the sole.

4. The sole according to claim 3, wherein the grooves, which define the passages on the second element, are extended outward and are inclined downward.

5. The sole according to claim 1, wherein the second element includes raised portions within the perimetric margin.

6. The sole according to claim 1, wherein the functional element comprises a membrane made of expanded polytetrafluoroethylene (e-PTFE), which is microporous, is waterproof, and permeable to water vapor and air.

7. The sole according to claim 1, wherein the functional element comprises an insert with a monolithic, stratified and cohesive sheet structure, comprising a plurality of waterproof and vapor-permeable functional layers made of polymeric material that is waterproof and permeable to water vapor.

8. The sole according to claim 1, wherein the functional element comprises an insert with a monolithic structure made of polymeric material that is waterproof and permeable to water vapor.

9. The sole according to claim 1, wherein the margin defines on an upper part a sealing surface for joining the functional element to the first element.

10. The sole according to claim 1, wherein a first tread for resting on the ground is integrated with the first element in the lower part and a second ground resting tread is integrated with the second element in the lower part.

* * * * *